US011333168B2

(12) United States Patent
Iwata et al.

(10) Patent No.: US 11,333,168 B2
(45) Date of Patent: May 17, 2022

(54) PROPELLER FAN

(71) Applicant: DAIKIN INDUSTRIES, LTD., Osaka (JP)

(72) Inventors: Tooru Iwata, Osaka (JP); Hirotaka Tomioka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 95 days.

(21) Appl. No.: 16/604,727

(22) PCT Filed: Apr. 6, 2018

(86) PCT No.: PCT/JP2018/014727
§ 371 (c)(1),
(2) Date: Oct. 11, 2019

(87) PCT Pub. No.: WO2018/190267
PCT Pub. Date: Oct. 18, 2018

(65) Prior Publication Data

US 2020/0158129 A1 May 21, 2020

(30) Foreign Application Priority Data

Apr. 14, 2017 (JP) ..... JP2017-080264

(51) Int. Cl.
*F04D 29/38* (2006.01)
*F04D 29/32* (2006.01)

(52) U.S. Cl.
CPC ..... *F04D 29/386* (2013.01); *F04D 29/325* (2013.01); *F05D 2240/303* (2013.01); *F05D 2240/304* (2013.01)

(58) Field of Classification Search
CPC .... F04D 29/386; F04D 29/325; F04D 29/667; F04D 29/384; F05D 2240/303; F05D 2240/304; F05D 2240/307
See application file for complete search history.

(56) References Cited

U.S. PATENT DOCUMENTS

2019/0107118 A1* 4/2019 Arai ..... F04D 29/325

FOREIGN PATENT DOCUMENTS

CN 102341603 A 2/2012
EP 3043077 A1 7/2016
(Continued)

OTHER PUBLICATIONS

International Search Report, issued in PCT/JP2018/014727, dated Jun. 19, 2018.

*Primary Examiner* — Sabbir Hasan
(74) *Attorney, Agent, or Firm* — Birch, Stewart, Kolasch & Birch, LLP

(57) ABSTRACT

In a blade of a propeller fan, an inclination angle (φ) is made by a straight line passing through an outer circumferential side end and an inner circumferential side end of a radial cross section of the blade with a second plane orthogonal to a center axis of a hub. In a blade end of the blade, one end in front of the other end viewed in the rotation direction of the propeller fan is a leading blade end, while the other end behind the leading blade end is a trailing blade end. The blade is shaped such that the inclination angle (φ) monotonically increases, in the direction from the intermediate position toward the trailing blade end, in an area extending from an intermediate position between the leading blade end and the trailing blade end to the trailing blade end.

6 Claims, 11 Drawing Sheets

(56) References Cited

FOREIGN PATENT DOCUMENTS

| | | | | | |
|---|---|---|---|---|---|
| EP | 3085966 | A1 | | 10/2016 | |
| JP | 2001227498 | A | * | 8/2001 | ..... F04D 29/384 |
| JP | 2003-184792 | A | | 7/2003 | |
| JP | 2012-52443 | A | | 3/2012 | |
| JP | 2012052443 | A | * | 3/2012 | |

* cited by examiner

PROPELLER FAN

TECHNICAL FIELD

The present invention relates to a propeller fan for use in a blower or the like.

BACKGROUND ART

Conventionally, a propeller fan is widely used for a blower or the like. For example, Patent Document 1 discloses a propeller fan having a hub and three blades. When the propeller fan rotates, air flows in the direction of the rotational center axis of the propeller fan. In each of the blades of the propeller fan, the side facing in the direction of air blowing is a positive pressure surface, while the other side opposite to the direction of air blowing is a negative pressure surface.

CITATION LIST

Patent Document

Patent Document 1: Japanese Unexamined Patent Publication No. 2012-052443

SUMMARY OF THE INVENTION

Technical Problem

In a blade of a propeller fan, air flows from the positive pressure surface side to the negative pressure surface side via the blade end of the blade, so that a tip vortex is generated. When the size of the blade end vortex changes during the rotation of the propeller fan, the flow rate of air flowing back from the positive pressure surface to the negative pressure surface of each of the blades changes, resulting in change in the pressure at the positive pressure surface side of each blade (i.e., the pressure of air blown out from the propeller fan). When the size of the tip vortex significantly changes during the rotation of the propeller fan, the variation range of the pressure of air blown out from the propeller fan increases. Accordingly, there arises a possibility of, for example, an increase in noise and decreased fan efficiency due to an increase in power necessary for driving the propeller fan.

In view of the foregoing, it is therefore an object of the present invention to keep the size of a tip vortex stable that may be generated at each of blades of the propeller fan, and to reduce the risk of the increase in noise and of the decrease in fan efficiency due to the tip vortex.

Solution to the Problem

A first aspect of the present disclosure is directed to a propeller fan comprising a cylindrical hub (15) and a plurality of blades (20) extending outwards from a side surface of the hub (15). Each of the plurality of blades (20) includes: a radial cross section that is a cross section of each of the blades (20) in a first plane (46) including a center axis of the hub (15); an inclination angle (φ) made by a straight line passing through an outer circumferential side end and an inner circumferential side end of the radial cross section with a second plane (47) orthogonal to the center axis of the hub (15); a blade end (22) that is an outer circumferential side end portion of the blade (20); a leading blade end (22*a*) that is a front end of the blade end (22) viewed in a rotation direction of the propeller fan; and a trailing blade end (22*b*) that is a rear end of the blade end (22) viewed in the rotation direction of the propeller fan. In this case, the inclination angle (φ) monotonically increases, in the direction from the intermediate position toward the trailing blade end (22*b*), in an area extending from an intermediate position located between the leading blade end (22*a*) and the trailing blade end (22*b*) to the trailing blade end (22*b*).

The phrase "monotonically increase" described in this specification is "weakly increase". Accordingly, in each blade (20), the inclination angle (φ) may continuously increase in the direction from the intermediate position toward the trailing blade end (22*b*), or may be constant in some sections extending from the intermediate position to the trailing blade end (22*b*).

According to a first aspect, the inclination angle (φ) is an index indicating the degree of the inclination of the radial cross section with respect to the second plane (47) orthogonal to the center axis of the hub (15). Hence, in the blade (20) of this aspect, the inclination of the radial cross section with respect to the second plane (47) gradually increases in an area extending from the intermediate position to the trailing blade end (22*b*). As the inclination of the radial cross section with respect to the second plane (47) increases, air smoothly flows from the positive pressure surface side to the negative pressure surface side via the blade end (22) of the blade (20), resulting in that the size of the tip vortex can be kept from varying.

The tip vortex generated in the vicinity of the blade end (22) of the blade (20) develops larger in the direction to the trailing blade end (22*b*) of the blade end (22). On the other hand, in the blade (20) of the first aspect, the inclination angle (φ) gradually increases in an area extending from the intermediate position to the trailing blade end (22*b*). That is, in the blade (20) of this aspect, the inclination of the radial cross section with respect to the second plane (47) gradually increases in an area of the blade end (22) where the tip vortex is to develop. Accordingly, air smoothly flows from the positive pressure surface side to the negative pressure surface side via the blade end (22) of the blade (20) in an area of the blade (20) extending from the intermediate position to the trailing blade end (22*b*). Hence, in this aspect, the size of the tip vortex can be kept from varying.

In the second aspect of this disclosure according to the first aspect, each blade (20) is configured such that the inclination angle (φ) gradually increases, in the direction toward the trailing blade end (22*b*), only in the area extending from the intermediate position located between the leading blade end (22*a*) and the trailing blade end (22*b*) to the trailing blade end (22*b*).

Each blade (20) of the propeller fan (10) of the second aspect is configured such that the inclination angle (φ) monotonically increases, in the direction from the intermediate position toward the trailing blade end (22*b*), only in an area of the blade end (22) extending from an intermediate position to the trailing blade end (22*b*). In an area of the blade (20) extending from the leading blade end (22*a*) toward the intermediate position, the inclination angle (φ) may be kept constant, or may gradually decrease in the direction from the leading blade end (22*a*) to the intermediate position.

In the third aspect of this disclosure according to the first or second aspect, each blade (20) is configured such that the inclination angle (φ) gradually decreases, in the direction toward the trailing blade end (22*b*), in an area extending from the leading blade end (22*a*) to the intermediate position, and becomes minimum at the intermediate position.

Each blade (20) of the propeller fan (10) of the third aspect is configured such that the inclination angle (φ) gradually decreases, in the direction toward the trailing blade end (22*b*), in an area extending from the leading blade end (22*a*) to the intermediate position. Further, in each blade (20), the inclination angle (φ) becomes minimum at the intermediate position. That is, in each blade (20), the inclination angle (φ) becomes minimum in the radial cross section of the blade (20) in a plane including the intermediate position and the center axis of the hub (15).

In an fourth aspect of this disclosure according to any one of the first to third aspects, each of the plurality of blades (20) is configured such that a plane including the trailing blade end (22*b*) and the center axis of the hub (15) is a rear end plane (43), and that a trailing edge (24) of the blade (20) is located on the rear end plane (43) or in front of the rear end plane (43) viewed in the rotation direction of the propeller fan.

In each blade (20) of the propeller fan (10) of the fourth aspect, the trailing edge (24) is above the rear end plane (43) or in front of the rear end plane (43) viewed in the rotation direction of the propeller fan (10). The trailing blade end (22*b*) is a rear end of the blade end (22) viewed in the rotation direction of the propeller fan (10) and constitutes a trailing edge (24) of the blade (20). The trailing blade end (22*b*) is located above the rear end plane (43).

The portion of the trailing edge (24) of the blade (20) except the trailing blade end (22*b*) may be located on the rear end plane (43) as a whole, may be located in front viewed in the rotation direction of the propeller fan (10) as a whole, or may be partially located above the rear end plane (43) while the rest may be located in front viewed in the rotation direction of the propeller fan (10).

A blade of a conventional propeller fan has a rear area that is an area located behind the rear end plane viewed in the rotation direction of the propeller fan. However, such rear area scarcely contributes to the blowing ability of the propeller fan. Further, the friction between the rear area and air may lead to the consumption in power necessary for driving the propeller fan, which may result in decrease in efficiency of the propeller fan.

On the contrary, in the propeller fan (10) of the fourth aspect, the trailing edge (24) of each blade (20) is on the rear end plane (43) or in front of the rear end plane (43) viewed in the rotation direction of the propeller fan (10). That is, the blade (20) of this aspect has no rear area described above. Accordingly, the friction between the blade (20) and air leads to decrease in consumed power, resulting in improved efficiency of the propeller fan (10).

In a fifth aspect of this disclosure according to any one of the first to fourth aspects, each of the plurality of blades (20) is configured such that a distance between a chord line (31) and a mean line (32) in a blade cross section is set to be a camber, that a position on the chord line (31) at which the camber becomes maximum in the blade cross section is set to be a maximum camber position (A), that a ratio of a distance (d) from a leading edge (23) to the maximum camber position (A) in the blade cross section to a chord line length (c) is set to be a maximum camber position ratio (d/c), that an end of the blade (20) at the side of the hub (15) is a blade root (21), that the outer circumferential side end portion of the blade (20) is the blade end (22), and that the maximum camber position ratio (d/c) at the blade end (22) is larger than the maximum camber position ratio (d/c) at the blade root (21).

A tip vortex is generated in the vicinity of a position where the camber becomes maximum at the blade end (22) of the blade (20) of the propeller fan (10). As the generation position of this tip vortex approaches to the leading edge (23) of the blade (20), the tip vortex becomes longer, and energy consumed for the generation of the tip vortex increases.

In contrast, in each blade (20) of the propeller fan (10) of the fifth aspect, the maximum camber position ratio (d/c) at the blade end (22) is larger than the maximum camber position ratio (d/c) at the blade root (21). That is, in each blade (20), the maximum camber position (A) at which the camber becomes maximum in the blade cross section becomes closer to the trailing edge (24) at the blade end (22) of the blade (20) than in the case of conventional propeller fans. Therefore, the development of the tip vortex is suppressed and the tip vortex is shortened so that energy consumed for generation of the tip vortex is reduced and fan efficiency is improved.

In a sixth aspect of this disclosure according to any one of the first to fourth aspects, each of the plurality of blades (20) is configured such that a maximum value of a camber is a distance between the chord line (31) and the mean line (32) in the blade cross section and is set to be a maximum camber (f), that a ratio of the maximum camber (0 to a chord line length (c) in the blade cross section is set to be a camber ratio (f/c), that an end of the blade (20) at the side of the hub (15) is a blade root (21), that an outer circumferential side end portion of the blade (20) is a blade end (22), and that the camber ratio (f/c) becomes maximum in a reference blade cross section (33*b*) located between the blade root (21) and the blade end (22), and monotonically decreases in a direction from the reference blade cross section (33*b*) toward the blade root (21) and monotonically decreases in the direction from the reference blade cross section (33*b*) toward the blade end (22).

In each of the blades (20) provided to the propeller fan (10) according to the sixth aspect, the camber ratio (f/c) becomes maximum in the reference blade cross section (33*b*) separated from the blade root (21) by a predetermined distance. Further, in each blade (20), the camber ratio (f/c) monotonically decreases in the direction from the reference blade cross section (33*b*) toward the blade root (21) and in the direction from the reference blade cross section (33*b*) toward the blade end (22).

The phrase "monotonically decrease" described in this specification means "weakly decrease". Accordingly, in each blade (20), the camber ratio (f/c) may continuously decrease from the reference blade cross section (33*b*) toward the blade end (22), or may be constant in some sections between the reference blade cross section (33*b*) and the blade end (22).

The region in the vicinity of the blade root (21) of the blade (20) is near the hub (15), so that turbulence of airflow tends to occur. On the other hand, in each blade (20) of the propeller fan (10) of the sixth aspect, the camber ratio (f/c) monotonically decreases in the direction from the reference blade cross section (33*b*) toward the blade root (21). That is, the camber ratio (f/c) is smaller in an area in the vicinity of the blade root (21) of the blade (20) where turbulence of airflow tends to occur than in the reference blade cross section (33*b*). Therefore, turbulence of airflow in the vicinity of the blade root (21) of each blade (20) is suppressed, and energy consumed by the disturbance is reduced. As a result, fan efficiency is improved.

On the other hand, in each blade (20) of the propeller fan (10) of the sixth aspect, the camber ratio (f/c) monotonically decreases in the direction from the reference blade cross section (33*b*) toward the blade end (22). That is, in each blade (20), the camber ratio (f/c) monotonically decreases in the direction from the reference blade cross section (33*b*) toward the blade end (22) where the circumferential speed is faster than that of the reference blade cross section (33*b*). Therefore, the work amount of the blade (20) (specifically, the lift force applied to the blades (20)) is averaged over the entire blade (20), so that the fan efficiency is improved.

Advantages of the Invention

Each blade (20) of the propeller fan (10) of the first aspect is configured such that the inclination angle (φ) monotonically increases, in the direction from the intermediate position toward the trailing blade end (22*b*), in an area extending from an intermediate position to the trailing blade end (22*b*) of the blade end (22). Accordingly, in an area of the blade end (22) closer to a trailing blade end (22*b*) where tip vortex is to develop, air can smoothly flow from the positive pressure surface side toward the negative pressure surface side via the blade end (22) of the blade (20), thereby making it possible to keep the size of the tip vortex from varying. Hence, according to this aspect, the increase in noise and the decrease in fan efficiency due to the tip vortex can be suppressed.

In each blade (20) of the propeller fan (10) of the fourth aspect, there is no rear area located behind the rear end plane (43) viewed in the rotation direction of the propeller fan (10). Accordingly, it is possible to reduce the consumed power due to the friction between the blade (20) and air, thereby improving the efficiency of the propeller fan (10) without deterioration of the blowing ability of the fan.

In the fifth aspect described above, in each blade (20) of the propeller fan (10), the maximum camber position ratio (d/c) at the blade end (22) is larger than the maximum camber position ratio (d/c) at the blade root (21). Therefore, the development of the tip vortex is suppressed and the tip vortex is shortened so that energy consumed for the generation of the tip vortex is reduced. As a result, according to this aspect, the fan efficiency can be improved by reducing the loss of power of driving the propeller fan (10) to rotate.

According to the sixth aspect described above, in each blade (20) of the propeller fan (10), the camber ratio (f/c) becomes maximum in the reference blade cross section (33*b*) located between the blade root (21) and the blade end (22), and monotonically decreases in the direction from the reference blade cross section (33*b*) toward the blade root (21) and monotonically decreases in the direction from the reference blade cross section (33*b*) toward the blade end (22). Therefore, turbulence of airflow in the vicinity of the blade root (21) of each blade (20) can be suppressed, and the work amount of each blade (20) can be averaged over the entire blade (20). Therefore, according to this aspect, the loss of power of driving the propeller fan (10) to rotate can be further reduced, and fan efficiency can be further improved.

DESCRIPTION OF EMBODIMENTS

Embodiments of the present invention will be described in detail with reference to the drawings. Note that the following embodiments and variations are merely beneficial examples in nature, and are not intended to limit the scope, applications, or use of the invention.

First Embodiment

The first embodiment will be described. A propeller fan (10) of this embodiment is configured as an axial fan. The propeller fan (10) is provided, for example, in a heat source unit of an air conditioner, and is used to supply outdoor air to a heat-source-side heat exchanger.

Propeller Fan Configuration

Figure 1:
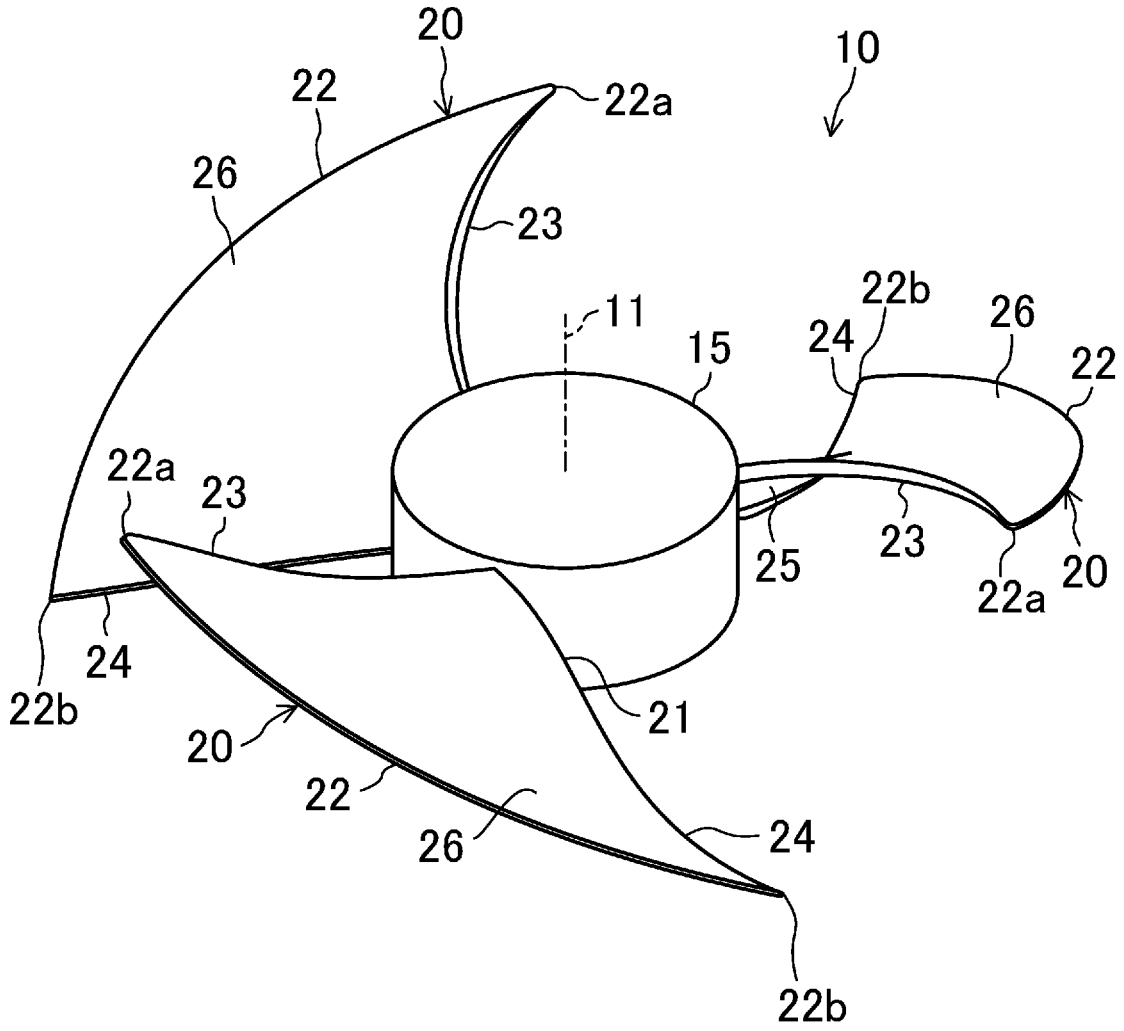
FIG. 1 is a perspective view of a propeller fan of a first embodiment.
Figure 2:
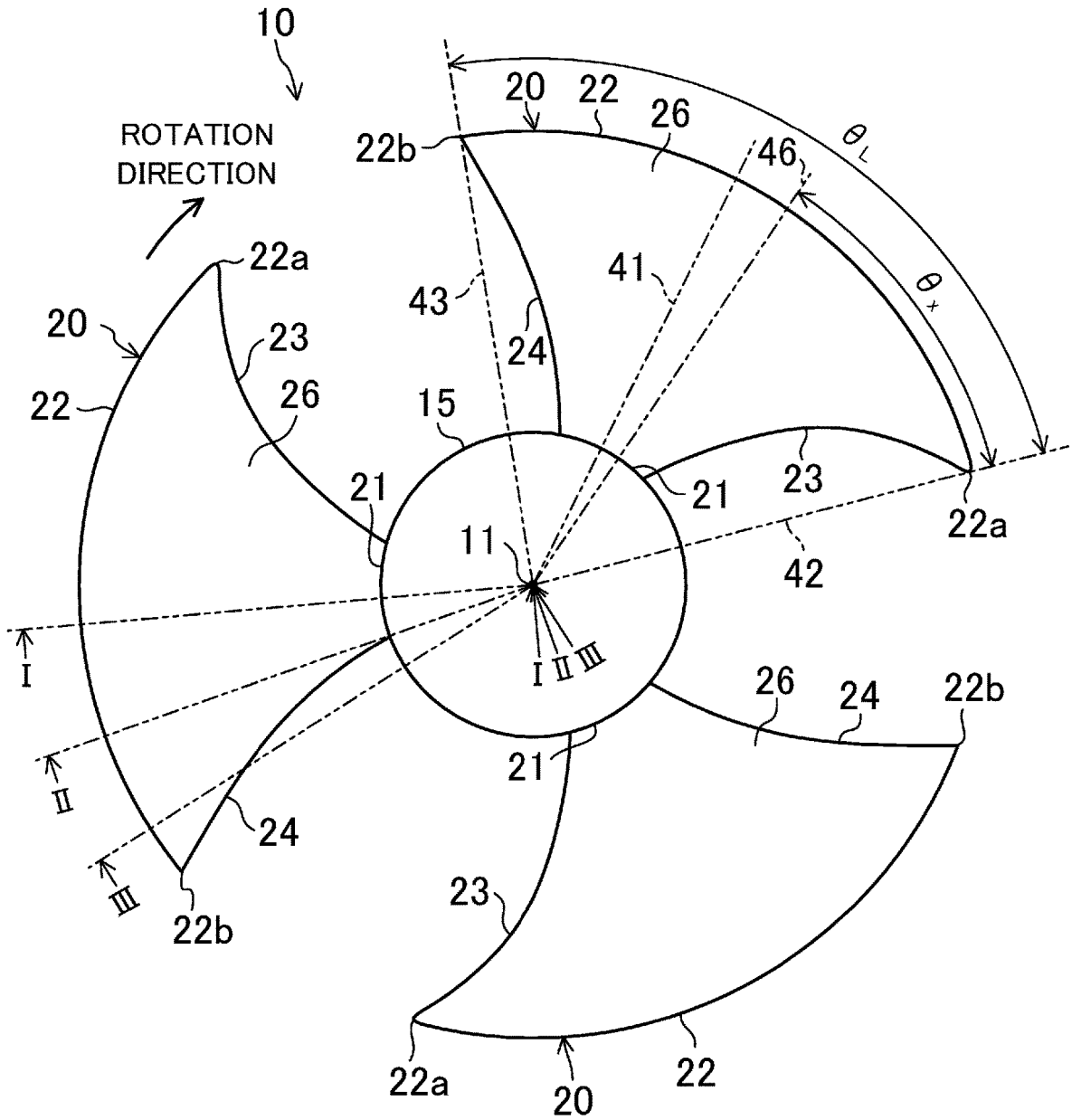
FIG. 2 is a plan view of the propeller fan of the first embodiment.
Figure 6:
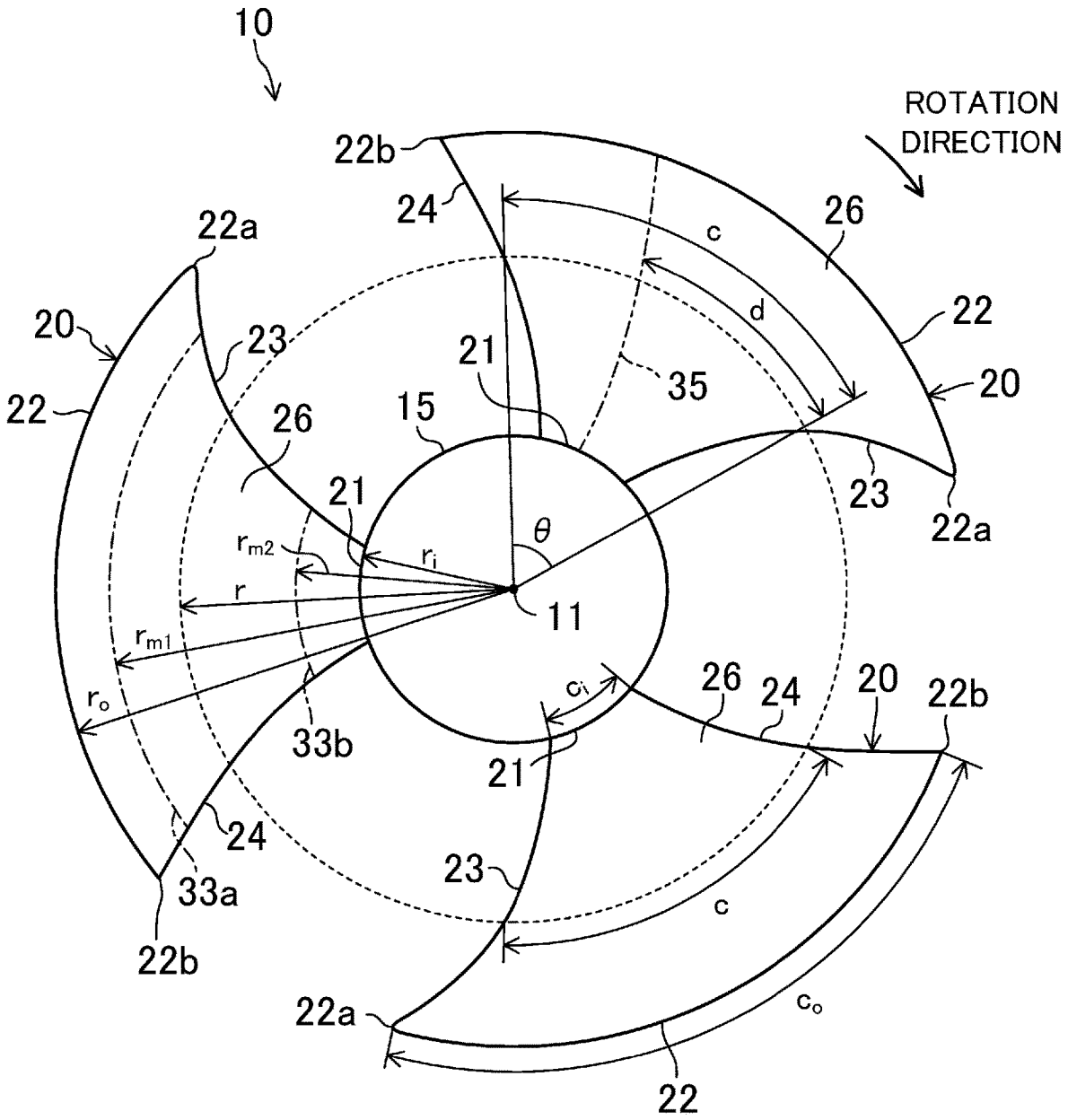
FIG. 6 is a plan view of the propeller fan of the first embodiment.

As shown in FIGS. 1, 2, and 6, the propeller fan (10) of this embodiment includes one hub (15) and three blades (20). The hub (15) and the three blades (20) are integrally formed. The propeller fan (10) is made of a resin.

The hub (15) is formed into a shape of a cylinder whose tip end face (upper surface shown in FIG. 1) is closed. The hub (15) is attached to a drive shaft of a fan motor. The center axis of the hub (15) is a rotational center axis (11) of the propeller fan (10).

Each blade (20) is arranged to project outwards from the outer peripheral surface of the hub (15). The three blades (20) are arranged at regular angular intervals in the circumferential direction of the hub (15). Each blade (20) has a shape extending toward the outside in the radial direction of the propeller fan (10). The blades (20) have the identical shape.

The blade (20) is configured such that an end portion on a radial center side (i.e., a hub (15) side) of the propeller fan (10) is a blade root (21), and an outer end portion in a radial direction of the propeller fan (10) is a blade end (22). The blade root (21) of each blade (20) is joined to the hub (15). The distance $r_i$ from the rotational center axis (11) to the blade root (21) of the propeller fan (10) is substantially constant over the entire length of the blade root (21). The distance $r_o$ from the rotational center axis (11) to the blade end (22) of the propeller fan (10) is also substantially constant over the entire length of the blade end (22).

The blade (20) is configured such that one edge in front of the other edge viewed in the rotation direction of the propeller fan (10) is a leading edge (23), while the other edge behind the leading edge viewed in the rotation direction of the propeller fan (10) is a trailing edge (24). The leading edge (23) and the trailing edge (24) of the blade (20) extend from the blade root (21) toward the blade end (22) and thus extend toward the outer circumferential side of the propeller fan (10).

According to this embodiment, the blade end (22) of the blade (20) is configured such that one end in front of the other end viewed in the rotation direction of the propeller fan (10) is a leading blade end (22*a*), while the other end behind the leading blade end viewed in the rotation direction of the propeller fan (10) is a trailing blade end (22*b*). The leading blade end (22*a*) is also an end of the leading edge (23) positioned radially outside of the propeller fan (10). The trailing blade end (22*b*) is also an end of the trailing edge (24) positioned radially outside of the propeller fan (10).

The blade (20) is inclined with respect to a plane orthogonal to the rotational center axis (11) of the propeller fan (10). Specifically, the blade (20) is arranged such that the leading edge (23) is located near a tip end (upper end shown in FIG. 1) of the hub (15), and the trailing edge (24) is located near a base end (lower end shown in FIG. 1) of the hub (15). The blade (20) is configured such that a front surface (a downward face in FIG. 1) in the rotation direction of the propeller fan (10) is a positive pressure surface (25), and a rear surface (an upward face in FIG. 1) in the rotation direction of the propeller fan (10) is a negative pressure surface (26).

As shown in FIG. 2, each blade (20) is configured such that a portion in the vicinity the leading blade end (22*a*) has a shape extending and pointing forward in the rotation direction of the propeller fan (10). The leading edge (23) of each blade (20) is positioned as a whole except the leading blade end (22*a*) behind a front end plane (42) viewed in the rotation direction of the propeller fan (10). The front end plane (42) of each blade (20) is a plane including the rotational center axis (11) of the propeller fan (10) and also the leading blade end (22*a*) of each blade (20).

Further, each blade (20) is configured such that a portion in the vicinity of the trailing blade end (22*b*) has a shape extending and pointing in the direction opposite to the rotation direction of the propeller fan (10). The trailing edge (24) of each blade (20) is positioned as a whole except the trailing blade end (22*b*) in front of a rear end plane (43) viewed in the rotation direction of the propeller fan (10). The rear end plane (43) of each blade (20) is a plane including the rotational center axis (11) of the propeller fan (10) and also the trailing blade end (22*b*) of each blade (20).

As shown in FIG. 2, the angle made between a first plane (46) and the front end plane (42) of each blade (20) is referred to as an angle $\theta_x$. The rear end plane (43) of each blade (20) is the first plane (46) with the angle $\theta_x=\theta_L$.

Detailed Shape of Blades

Hereinafter, the shape of the blade (20) will be described in detail.

«Radial Cross Section»

Figure 3:
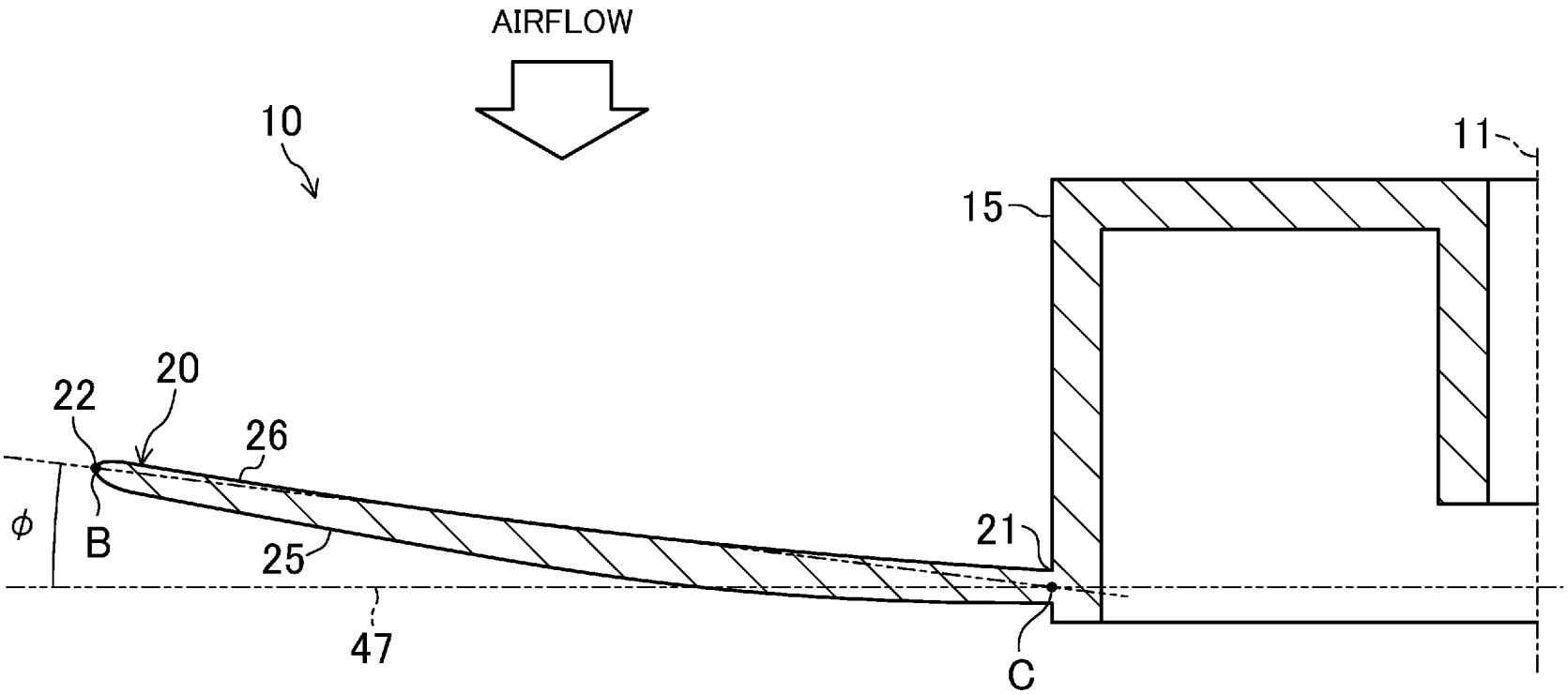
FIG. 3 is a cross-sectional view of a radial direction cross section of a blade of the propeller fan of the first embodiment.

The radial cross section of each blade (20) shown in FIG. 3 is a cross section of the blade in the first plane (46). The first plane (46) is a plane including a hub center axis (i.e., the rotational center axis (11) of the propeller fan (10)). As shown in FIG. 3, the blade (20) inclines toward the negative pressure surface (26) side.

In the radial cross section of the blade (20) of FIG. 3, a point B is a midpoint between ends close to the outside of the radial cross section (center in a thickness direction), while a point C is a midpoint between ends close to the center of the radial cross section (center in the thickness direction). In this radial cross section, a line passing through the points B and C and a second plane (47) makes an angle that is the inclination angle $_9$ of the blade (20). The second plane (47) is a plane orthogonal to a hub center axis (i.e., the rotational center axis (11) of the propeller fan (10)).

«Inclination Angle»

Figure 4:
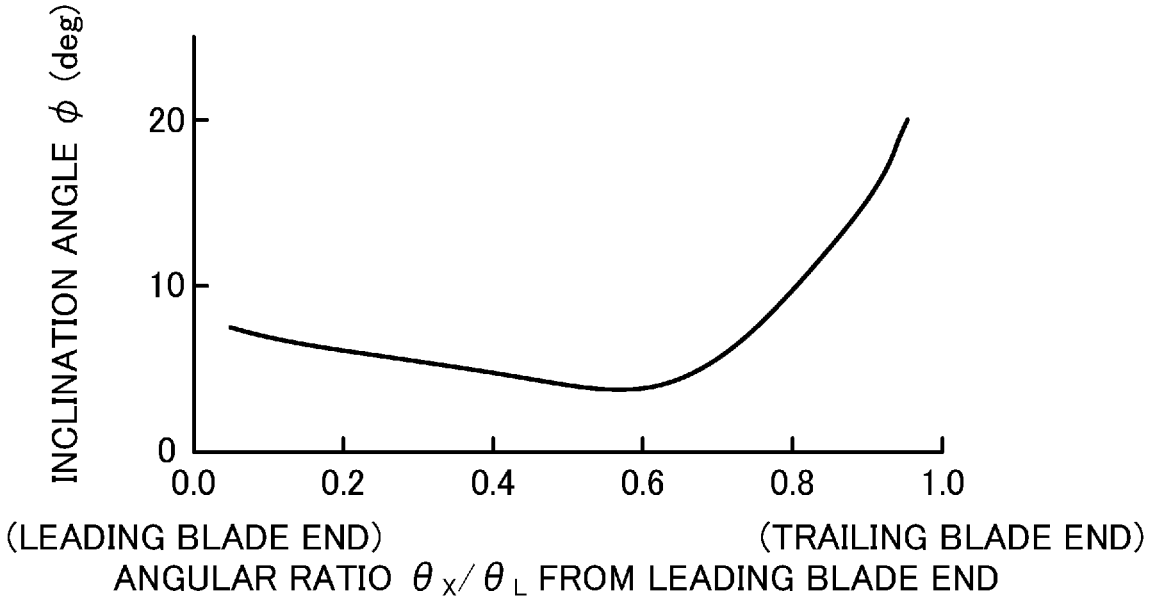
FIG. 4 is a graph showing the relationship between an angular ratio $\theta_x/\theta_L$ from a leading blade end and an inclination angle φ in the blade of the propeller fan of the first embodiment.

As shown in FIG. 4, in the blade (20) of this embodiment, the inclination angle (in the radial cross section varies in accordance with the angle $\theta_x$ from the front end plane (42). This inclination angle $\varphi$ varies on a way from the leading blade end (22*a*) to the trailing blade end (22*b*) of the blade end (22) (i.e., on a way from the front end plane (42) to the rear end plane (43)) such that the inclination angle $\varphi$ becomes relative minimum only once and never becomes relative maximum.

Specifically, the inclination angle reaches the minimum value in a reference radial cross section (41) located between the leading blade end (22*a*) and the trailing blade end (22*b*) (i.e., between the front end plane (42) and the rear end plane (43)). In an area of the blade (20) closer to the leading blade end (22*a*) than to the reference radial cross section (41), the inclination angle $\varphi$ gradually decreases as the angle $\theta_x$ with the front end plane (42) increases (i.e., in the direction opposite to the rotation direction of the propeller fan). On the other hand, in an area of the blade (20) closer to the trailing blade end (22*b*) than to the reference radial cross section (41), the inclination angle $\varphi$ gradually increases as the angle $\theta_x$ from the front end plane (42) increases (i.e., in the direction opposite to the rotation direction of the propeller fan). In this way, in the blade (20) of this embodiment, the inclination angle ($\varphi$) gradually increases, in the direction toward the trailing blade end (22*b*), only in an area extending from an intermediate position (i.e., in the reference radial cross section (41)) located between the leading blade end (22*a*) and the trailing blade end (22*b*) to the trailing blade end (22*b*).

Figure 5A:
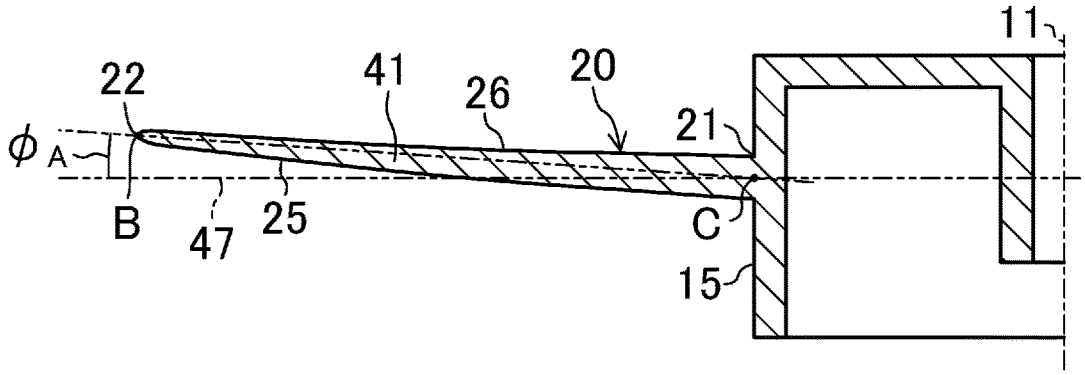
FIG. 5A is a cross-sectional view of the propeller fan taken along I-I of FIG. 2.
Figure 5B:
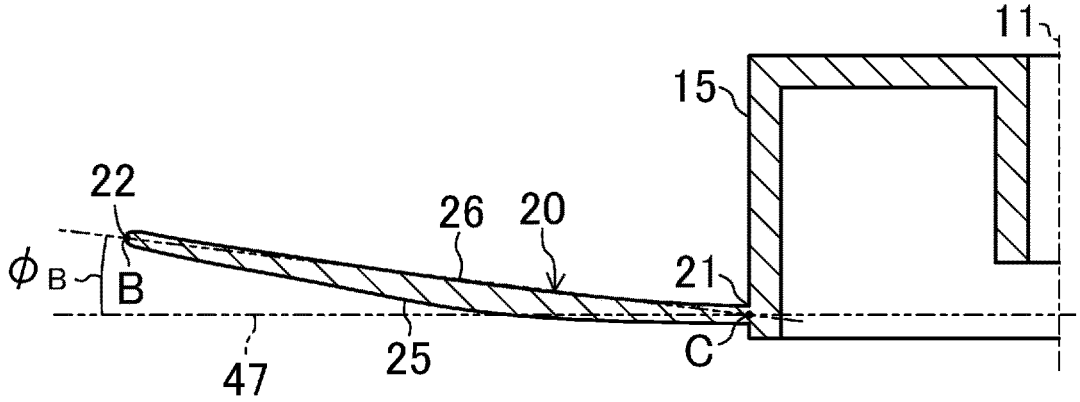
FIG. 5B is a cross-sectional view of the propeller fan taken along II-II of FIG. 2.
Figure 5C:
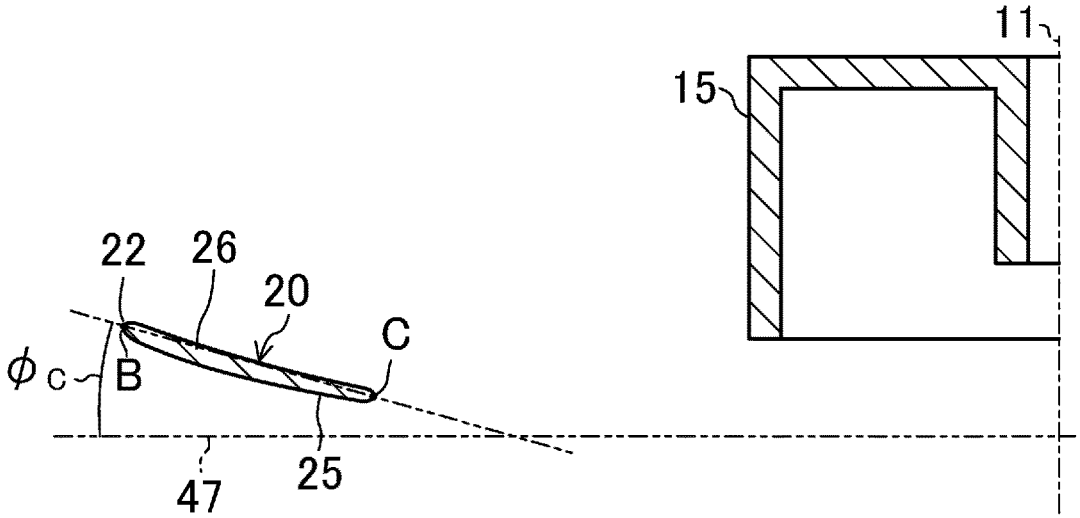
FIG. 5C is a cross-sectional view of the propeller fan taken along of FIG. 2.

The radial cross section of each blade (20) shown in FIG. 5A is a reference radial cross section (41). The radial cross section of each blade (20) shown in FIGS. 5B and 5C is located closer to the trailing blade end (22*b*) than to the reference radial cross section (41). Further, the inclination angle $\varphi_C$ in the radial cross section shown in FIG. 5C (in the cross section taken along III-III of FIG. 2) is larger than the inclination angle $\varphi_B$ in the radial cross section of FIG. 5B ($\varphi_B<\varphi_C$), and the inclination angle $\varphi_B$ is larger than the inclination angle $\varphi_A$ in the radial cross section of FIG. 5A (in the cross section taken along I-I of FIG. 2) ($\varphi_A<\varphi_B$.

In the blade (20) of this embodiment, the inclination angle $\varphi$ at the trailing blade end (22*b*) is larger than the inclination angle $\varphi$ at the leading blade end blade end (22*a*). Note that FIG. 4 shows neither the value of the inclination angle φ at the leading blade end (22*a*) (angular ratio $\theta_x/\theta_L$=0.0) nor the value of the inclination angle φ at the trailing blade end (22*b*) (angular ratio $\theta_x/\theta_L$=1.0). The reason for this is as follows: It is substantially impossible to measure the value of the inclination angle φ since the length of the radial cross section becomes significantly short around the leading blade end (22*a*) and the trailing blade end (22*b*) Accordingly, in a curve showing the change of the inclination angle φ of FIG. 4, the value at the left end is substantially regarded as the value of the inclination angle φ at the leading blade end (22*a*), while the value at the right end is substantially regarded as the value of the inclination angle φ at the trailing blade end (22*b*).

«Blade Cross Section»

Figure 7:
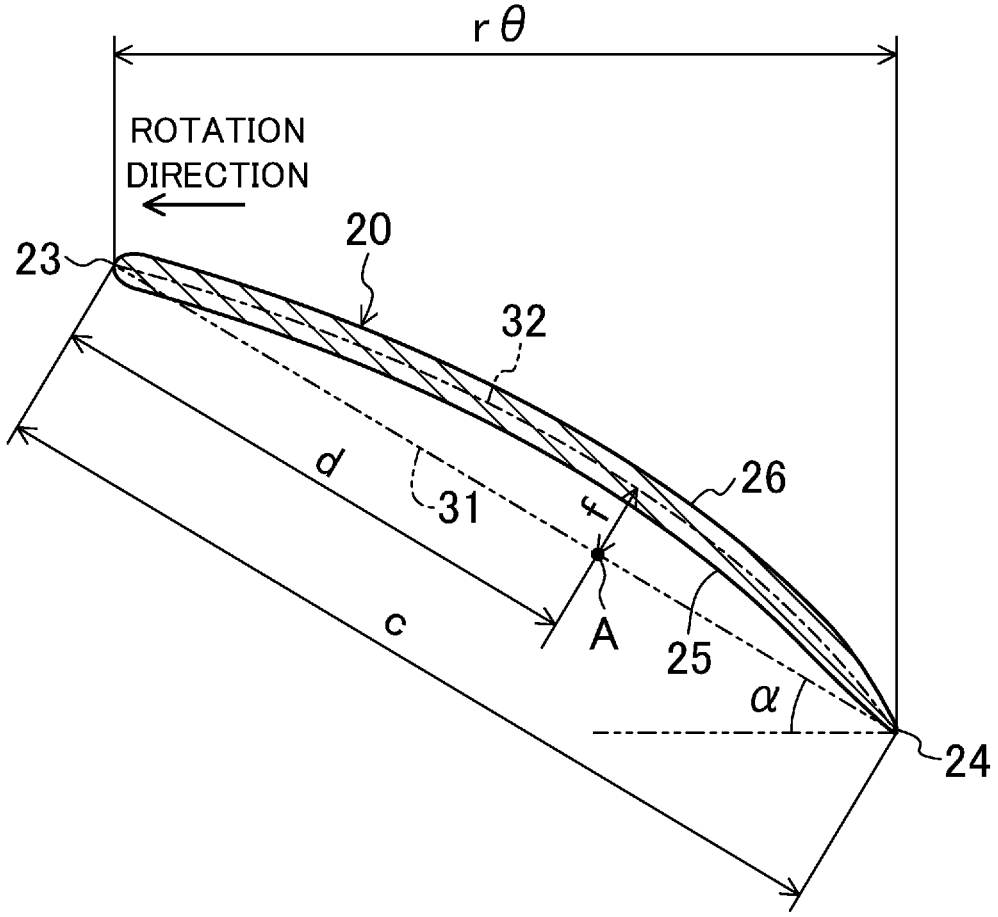
FIG. 7 is a cross-sectional view of a blade cross section of a blade of the propeller fan of the first embodiment.

The blade cross section shown in FIG. 7 is a view in which a curved cross section, of a blade (20), located at a distance r from a rotational center axis (11) of a propeller fan (10) is shown in a flattened state. As shown in FIG. 7, the blade (20) is cambered so as to bulge toward the negative pressure surface (26) side.

In the blade cross section shown in FIG. 7, a line segment connecting the leading edge (23) and the trailing edge (24) is a chord line (31), and an angle formed by the chord line (31) with a "plane orthogonal to the rotational center axis (11) of the propeller fan (10)" is an attaching angle α. The chord line length c is a value obtained through dividing the arc length rθ having an arc radius r and a central angle θ by a cosine coca with respect to the attaching angle α (c=rθ/cosα). Note that θ is a central angle of the blade (20) at the position located with the distance r from the rotational center axis (11) of the propeller fan (10) (see FIG. 2), and the unit thereof is radian.

In the blade cross section shown in FIG. 7, a line connecting the midpoints of the positive pressure surface (25) and the negative pressure surface (26) is a mean line (32), and the distance from the chord line (31) to the mean line (32) is a camber. The camber gradually increases in the direction from the leading edge (23) to the trailing edge (24) along the chord line (31), reaches the maximum value halfway between the leading edge (23) and the trailing edge (24), and gradually decreases in the direction from the position, at which the camber reaches the maximum value, toward the trailing edge (24). The maximum value of the camber is the maximum camber f, and the position on the chord line (31) where the camber reaches the maximum camber f is the maximum camber position A. Further, the distance from the leading edge (23) to the maximum camber position (A) is represented by d.

<Camber Ratio>

Figure 8:
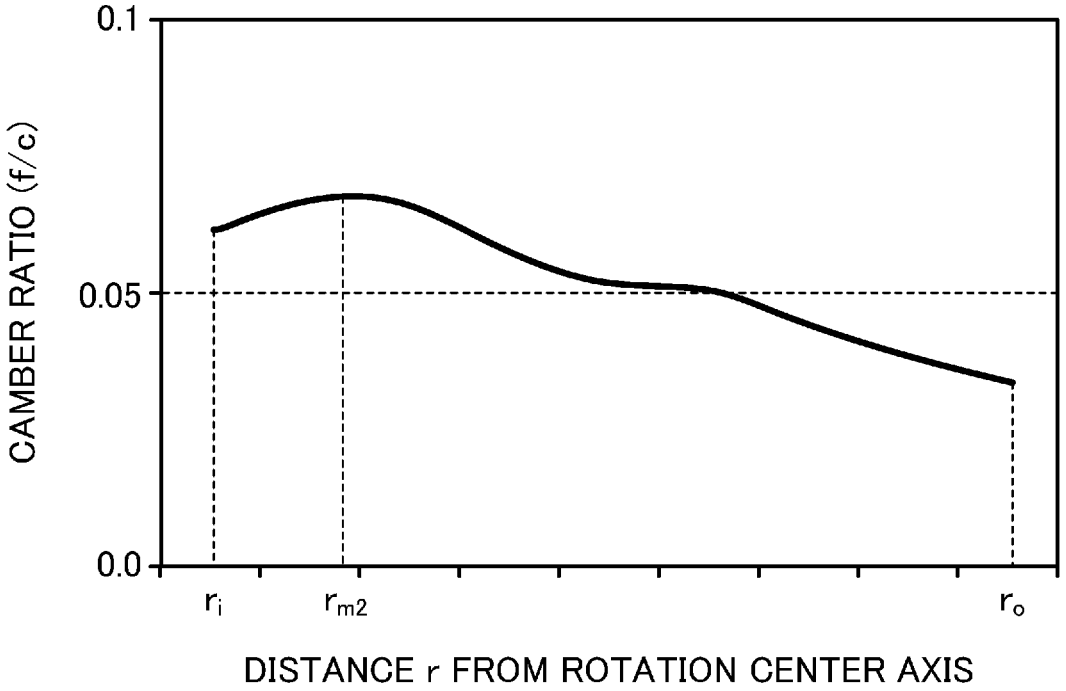
FIG. 8 is a graph showing a relationship between a distance r from the rotational center axis and the camber ratio (f/c) of the blade of the propeller fan of the first embodiment.

As shown in FIG. 8, in the blade (20) of this embodiment, the camber ratio (f/c), which is the ratio of the maximum camber f to the chord line length c in the blade cross section, varies in accordance with the distance from the rotational center axis (11) of the propeller fan (10). This camber ratio (f/c) varies on a way from the blade root (21) to the blade end (22) such that the camber ratio becomes relative maximum only once and never becomes relative minimum.

Specifically, the camber ratio (f/c) reaches the maximum value ($f_{m2}/c_{m2}$) in the second reference blade cross section (33*b*) located between the blade root (21) and the blade end (22). Note that $f_{m2}$ is the maximum camber in the second reference blade cross section (33*b*), and $c_{m2}$ is the chord line length in the second reference blade cross section (33*b*) (see FIG. 10B).

The camber ratio (f/c) gradually increases in the direction from the blade root (21) toward the second reference blade cross section (33*b*), and gradually decreases in the direction from the second reference blade cross section (33*b*) toward the blade end (22). That is, when $r_i \le r \le r_{m2}$, the camber ratio (f/c) becomes larger as the distance r becomes larger, and when $r_{m2} \le r \le r_o$, the camber ratio (f/c) becomes smaller as the distance r becomes larger.

Here, the second reference blade cross section (33*b*) is a blade cross section at a position at which the distance from the rotational center axis (11) of the propeller fan (10) is represented by $r_{m2}$. That is, the second reference blade cross section (33*b*) is a blade cross section which is separated from the blade root (21) by a distance ($r_{m2}$-$r_i$). In this embodiment, the distance ($r_{m2}$-$r_i$) from the blade root (21) to the second reference blade cross section (33*b*) is about 15% of the distance ($r_o$-$r_i$) from the blade root (21) to the blade end (22). That is, the second reference blade cross section (33*b*) is located closer to the blade root (21) than to the center of the blade root (21) and the blade end (22) in the radial direction of the propeller fan (10).

In the blade (20) of this embodiment, the camber ratio ($f_o/c_o$) at the blade end (22) is smaller than the camber ratio ($f_i/c_i$) at the blade root (21). Specifically, the camber ratio ($f_o/c_o$) at the blade end (22) is about 55% of the camber ratio ($f_i/c_i$) at the blade root (21). Note that 1; is the maximum camber at the blade root (21), and $c_i$ is the chord line length at the blade root (21) (see FIG. 10A). Further, $f_o$ is the maximum camber at the blade end (22), and $c_o$ is the chord line length at the blade end (22) (see FIG. 10C).

<Maximum Camber Position Ratio>

Figure 9:
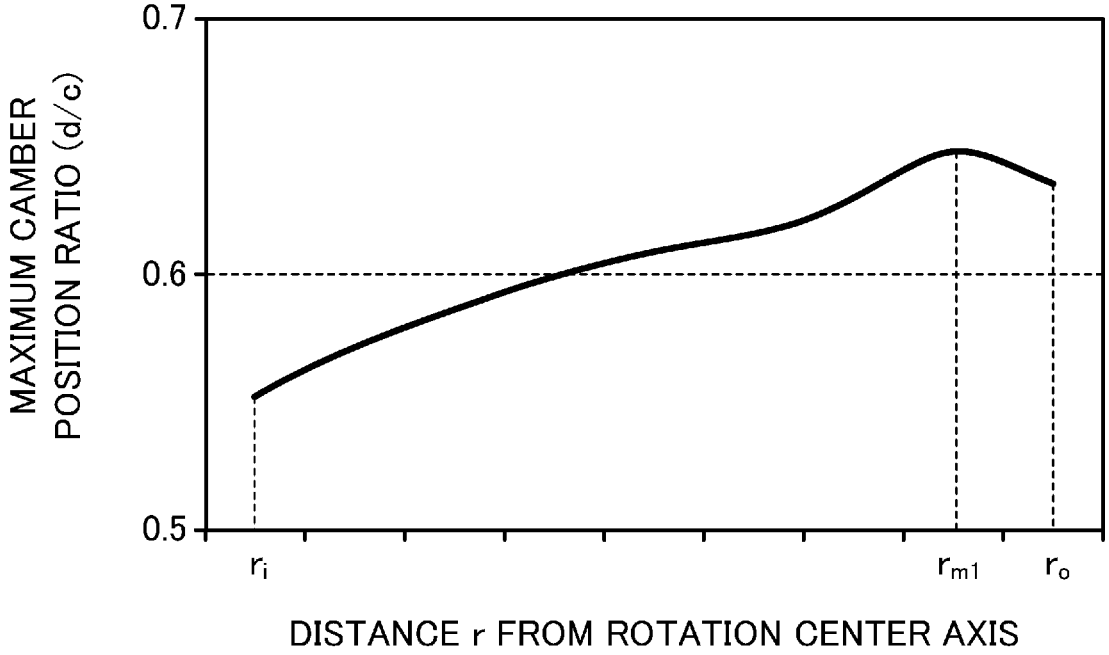
FIG. 9 is a graph showing a relationship between the distance r from the rotational center axis and the maximum camber position ratio (d/c) of the blade of the propeller fan of the first embodiment.

As shown in FIG. 9, in the blade (20) of this embodiment, the maximum camber position ratio (d/c), which is the ratio of the distance d between the leading edge (23) and the maximum camber position A to the chord line length c, varies in accordance with the distance from the rotational center axis (11) of the propeller fan (10). The maximum camber position ratio (d/c) varies on a way from the blade root (21) to the blade end (22) such that the maximum camber position ratio becomes relative maximum only once and never becomes relative minimum.

Specifically, the maximum camber position ratio (d/c) reaches the maximum value ($d_{m1}/c_{m1}$) in the first reference blade cross section (33*a*) located between the blade root (21) and the blade end (22). Note that $d_{m1}$ is the distance from the leading edge (23) to the maximum camber position A in the first reference blade cross section (33*a*).

The maximum camber position ratio (d/c) gradually increases in the direction from the blade root (21) toward the first reference blade cross section (33*a*), and gradually decreases in the direction from the first reference blade cross section (33*a*) toward the blade end (22). That is, when $r_i \le r \le r_{m1}$, the maximum camber position ratio (d/c) becomes larger as the distance r becomes larger, and when $r_{m1} \le r \le r_o$, the maximum camber position ratio (d/c) becomes smaller as the distance r becomes larger. As the maximum camber position ratio (d/c) increases, the maximum camber position A moves relatively farther away from the leading edge (23), and the maximum camber position A becomes relatively closer to the trailing edge (24). A maximum camber position line (35) connecting the maximum camber positions A in the blade cross section, which are respectively positioned at certain distances from the rotational center axis (11) of the propeller fan (10), is indicated by a long dashed double-short dashed line in FIG. 6.

Here, the first reference blade cross section (33*a*) is a blade cross section at a position at which the distance from the rotational center axis (11) of the propeller fan (10) is represented by $r_{m1}$. That is, the first reference blade cross section (33*a*) is a blade cross section which is separated from the blade root (21) by a distance ($r_{m1}$-$r_i$). In this embodiment, the distance ($r_{m1}$-$r_i$) from the blade root (21) to the first reference blade cross section (33*a*) is about 90% of the distance ($r_o$-$r_i$) from the blade root (21) to the blade end (22). That is, the first reference blade cross section (33*a*) is located closer to the blade end (22) than to the center of the blade root (21) and the blade end (22) in the radial direction of the propeller fan (10).

In the blade (20) of this embodiment, the maximum camber position ratio ($d_o/c_o$) at the blade end (22) is larger than the maximum camber position ratio ($d_i/c_i$) at the blade root (21). Note that $d_i$ is a distance from the leading edge (23) to the maximum camber position A in the blade root (21) (see FIG. 10A), and do is a distance from the leading edge (23) to the maximum camber position A in the blade end (22) (see FIG. 10C).

In the blade (20) of this embodiment, the maximum camber position ratio (d/c) is set to a value equal to or greater than 0.55 and equal to or smaller than 0.65 in all the blade cross sections. It is preferable that the maximum camber position ratio (d/c) is set to a value equal to or greater than 0.5 and equal to or smaller than 0.8.

<Attaching Angle>

Figure 10A:
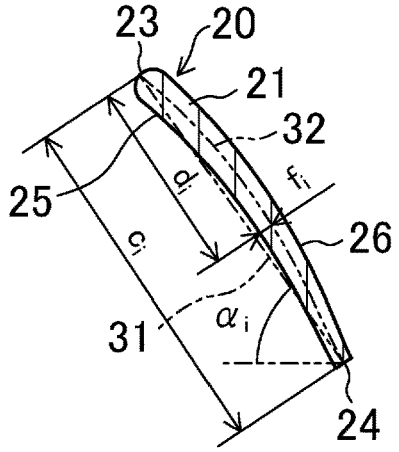
FIG. 10A is a cross-sectional view of the blade showing a blade cross section of a blade root of the blade of the propeller fan of the first embodiment.
Figure 10B:
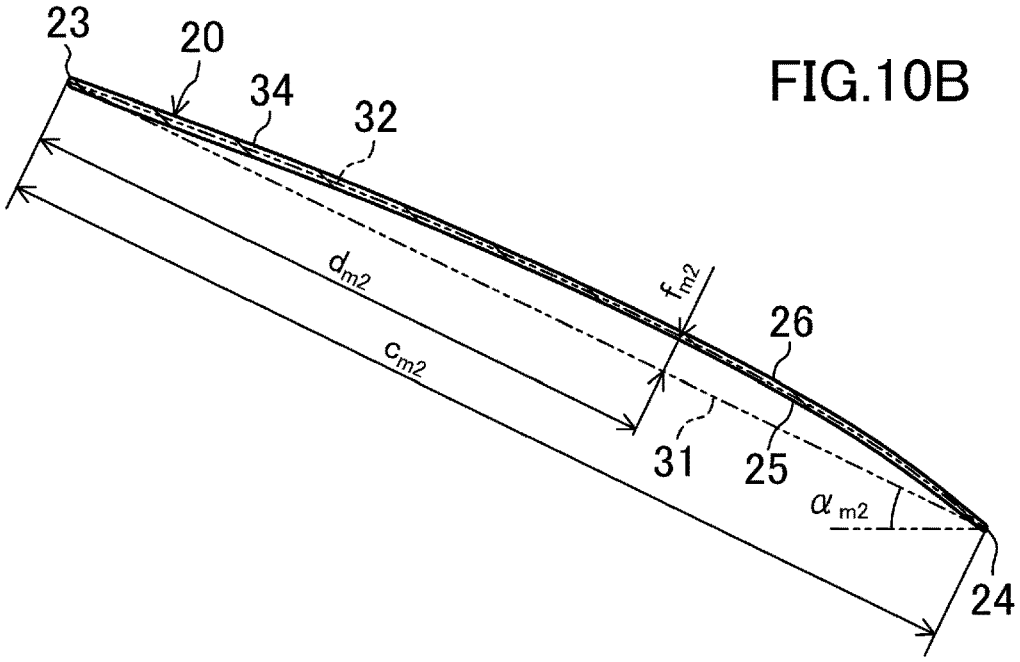
FIG. 10B is a cross-sectional view of the blade showing a second reference blade cross section of the blade of the propeller fan of the first embodiment.
Figure 10C:
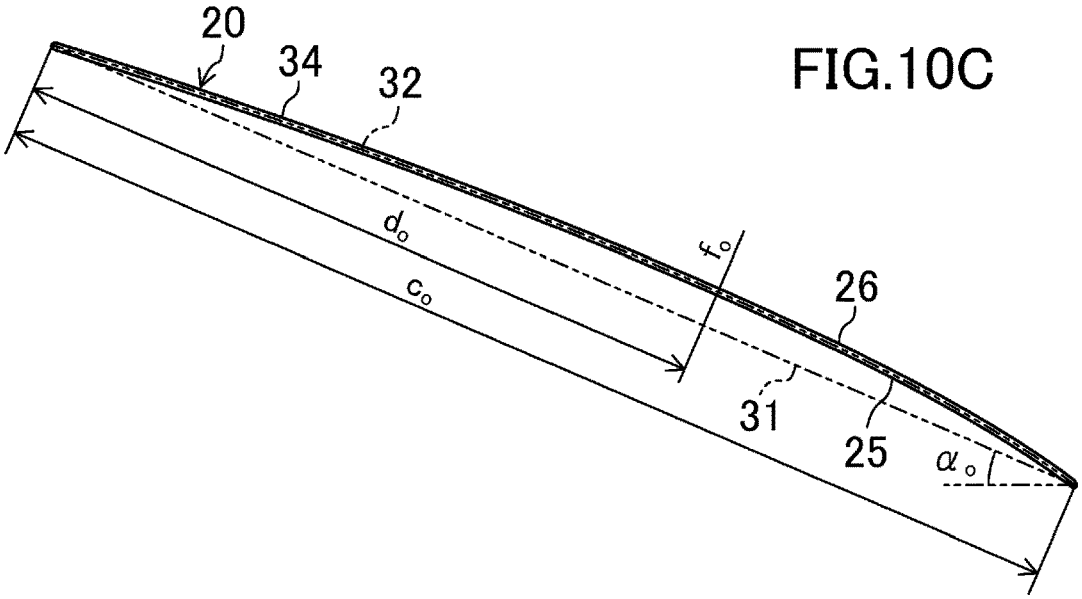
FIG. 10C is a cross-sectional view of the blade showing a blade cross section of a blade end of the blade of the propeller fan of the first embodiment.

As shown in FIG. 10A to FIG. 10C, in the blade (20) of this embodiment, the attaching angle a gradually decreases in the direction from the blade root (21) toward the blade end (22). That is, the attaching angle a becomes smaller as the blade cross section is farther away from the rotational center axis (11) of the propeller fan (10). Therefore, in the blade (20) of this embodiment, the attaching angle $\alpha_i$ at the blade root (21) reaches the maximum value, and the attaching angle $a_o$ at the blade end (22) reaches the minimum value.

Blowing Effect of Propeller Fan

The propeller fan (10) of this embodiment is driven by a fan motor connected to a hub (15), and rotates in the clockwise direction of FIG. 2. When the propeller fan (10) rotates, air is pushed out in the direction of the rotational center axis (11) of the propeller fan (10) by the blades (20).

In each blade (20) of the propeller fan (10), the air pressure on the positive pressure surface (25) side becomes higher than the atmospheric pressure, and the air pressure on the negative pressure surface (26) side becomes lower than the atmospheric pressure. Therefore, lift force is applied to each of the blades (20) of the propeller fan (10). The lift force pushes the blades (20) in the direction from the positive pressure surface (25) toward the negative pressure surface (26). The lift force is a reaction force for the force with which each of the blades (20) of the propeller fan (10) pushes out air. Accordingly, the larger the lift force applied to the blades (20), the larger the work amount of the blades (20) pushing out air.

<Relationship of Inclination Angle to Airflow>

As described above, in each blade (20) of the propeller fan (10) during rotation, the air pressure on the positive pressure surface (25) side becomes higher than the atmospheric pressure, and the air pressure on the negative pressure surface (26) side becomes lower than the atmospheric pressure. Accordingly, in the blade (20), the air flows from the positive pressure surface (25) side toward the negative pressure surface (26) via the blade end (22) of the blade (20).

In the blade (20), air flows back from the positive pressure surface (25) side to the negative pressure surface (26) side via the blade end (22) of the blade (20), so that a tip vortex (90) is generated. When the size of the tip vortex (90) varies, there arises a change in the flow rate of the air flowing back from the positive pressure surface (25) side toward the negative pressure surface (26) side of the blade (20). As a result, the pressure at the positive pressure surface (25) side of the blade (i.e., pressure of air blown out from the propeller fan (10)) varies, which may lead to increase in blowing sound or decrease in fan efficiency.

On the contrary, in each blade (20) of the propeller fan (10) of this embodiment, the inclination angle (φ) gradually increases, in the direction toward the trailing blade end (22*b*), in an area extending from the reference radial cross section (41) to the trailing blade end (22*b*). The inclination angle (φ) is an index indicating the degree of the inclination of the radial cross section with respect to the second plane (47) orthogonal to the center axis of the hub (15). Hence, in the blade (20) of this embodiment, the inclination of the radial cross section with respect to the second plane (47) gradually increases in an area extending from the reference radial cross section (41) to the trailing blade end (22*b*).

As the inclination of the radial cross section with respect to the second plane (47) increases, the variation in direction of the airflow at the time when air flows via the blade end (22) becomes smaller. Accordingly, air smoothly flows from the positive pressure surface side to the negative pressure surface side via the blade end of the blade (20), thereby suppressing the variation in size of the tip vortex (90).

The tip vortex (90) generated in the vicinity of the blade end (22) of the blade (20) develops larger in the direction to the trailing blade end (22*b*) of the blade (22). On the other hand, in the blade (20) of this embodiment, the inclination angle φ gradually increases in an area extending from the reference radial cross section (41) to the trailing blade end (22*b*). That is, in the blade (20) of this embodiment, the inclination of the radial cross section with respect to the second plane (47) gradually increases in an area of the blade end (22) where the tip vortex (90) is to develop. Accordingly, air smoothly flows from the positive pressure surface side to the negative pressure surface side via the blade end (22) of the blade (20) in an area of the blade (20) extending from the reference radial cross section (41) to the trailing blade end (22*b*). Hence, in this embodiment, the variation in size of the tip vortex (90) can be suppressed.

<Relationship of the Camber Ratio to Airflow>

The region in the vicinity of the blade root (21) of the blade (20) in the propeller fan (10) is the vicinity of the hub (15), so that turbulence of airflow tends to occur. On the other hand, in each blade (20) of the propeller fan (10) of this embodiment, the camber ratio (f/c) gradually decreases in the direction from the second reference blade cross section (33*b*) toward the blade root (21). That is, the camber ratio (f/c) is smaller in a region in the vicinity of the blade root (21) of the blade (20) where turbulence of airflow tends to occur than in the second reference blade cross section (33*b*). Therefore, turbulence of airflow in the vicinity of the blade root (21) of each blade (20) is suppressed, and energy consumed by the disturbance is reduced. As a result, fan efficiency is improved, and power consumption of the fan motor driving the propeller fan (10) is reduced.

In addition, in each blade (20) of the propeller fan (10) of this embodiment, the camber ratio (f/c) gradually decreases in the direction from the second reference blade cross section (33*b*) toward the blade end (22). That is, in each blade (20), the camber ratio (f/c) gradually decreases in the direction from the second reference blade cross section (33*b*) toward the blade end (22) where the circumferential speed is faster than that of the second reference blade cross section (33*b*). Therefore, the work amount of the blade (20)

(specifically, the lift force applied to the blades (20)) is averaged over the entire blade (20), so that the fan efficiency is improved.

Here, in each blade (20) of the propeller fan (10), the circumferential speed of the blade end (22) is higher than that of the blade root (21). Therefore, when the camber ratio ($f_o/c_o$) at the blade end (22) is approximately equal to the camber ratio ($f_i/c_i$) at the blade root (21), the air differential pressure between the positive pressure surface (25) side and the negative pressure surface (26) side near the blade end (22) of each blade (20) becomes too large, resulting in that the flow rate of air flowing from the positive pressure surface (25) side to the negative pressure surface (26) side via the blade end (22) of a blade (20) may increase, thereby causing decrease in fan efficiency.

On the other hand, in each blade (20) of the propeller fan (10) of this embodiment, the camber ratio ($f_o/c_o$) at the blade end (22) is approximately 56% of the camber ratio ($f_i/c_i$) at the blade root (21). Therefore, the air differential pressure between the positive pressure surface (25) side and the negative pressure surface (26) side in the vicinity of the blade end (22) of each blade (20) is suppressed to an extent which is not excessively large. As a result, the flow rate of air flowing back from the positive pressure surface (25) side to the negative pressure surface (26) side via the blade end (22) of each blade (20) can be reduced, thereby improving fan efficiency. Further, the tip vortex (90) generated in the vicinity of the blade end (22) is suppressed, so that energy consumed to generate the tip vortex (90) is reduced, which also results in improved fan efficiency.

<Relationship between Maximum Camber Position Ratio to Airflow>

Figure 12:
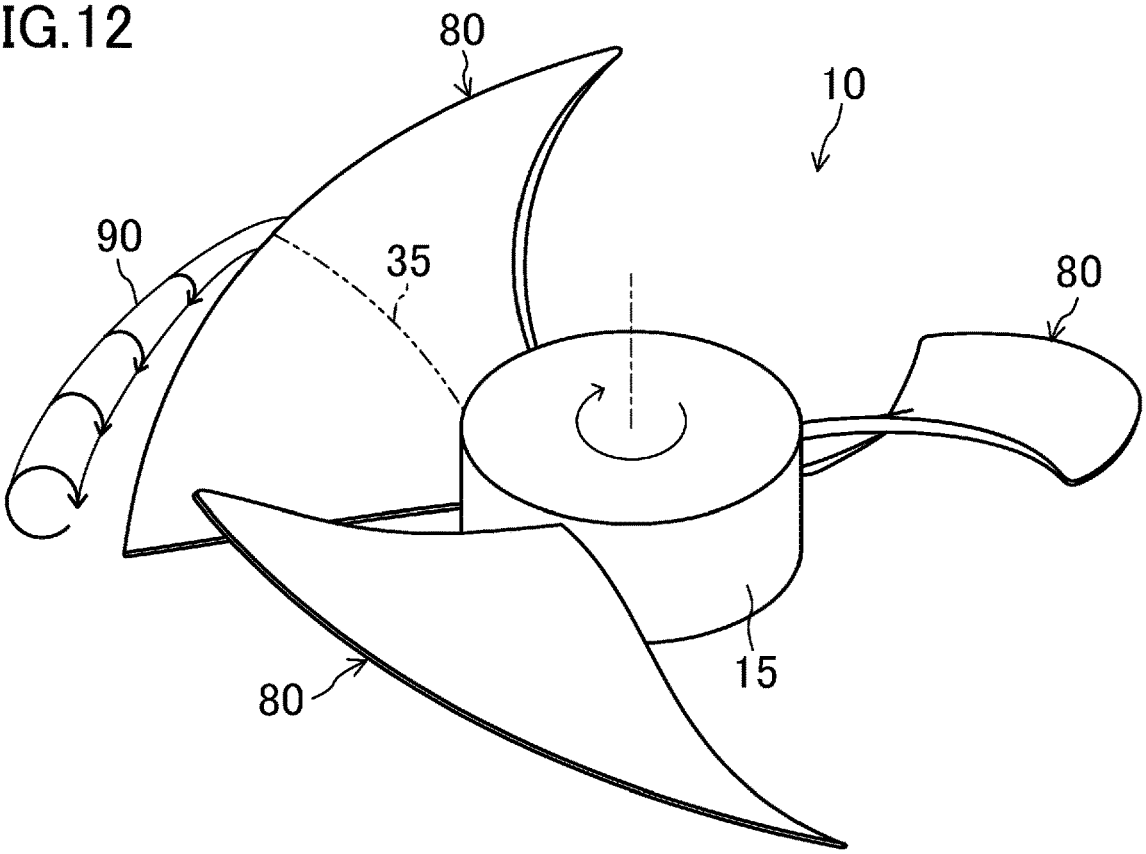
FIG. 12 is a perspective view of a conventional propeller fan showing an airflow on the conventional propeller fan.

In the blade (20) of the propeller fan (10), a tip vortex (90) is generated in the vicinity of a position where the camber becomes maximum at the blade end (22). As shown in FIG. 12, as the generation position of the tip vortex (90) approaches to the leading edge (23) of the blade (80), the tip vortex (90) becomes longer, and energy consumed for the generation of the tip vortex (90) increases.

Figure 11:
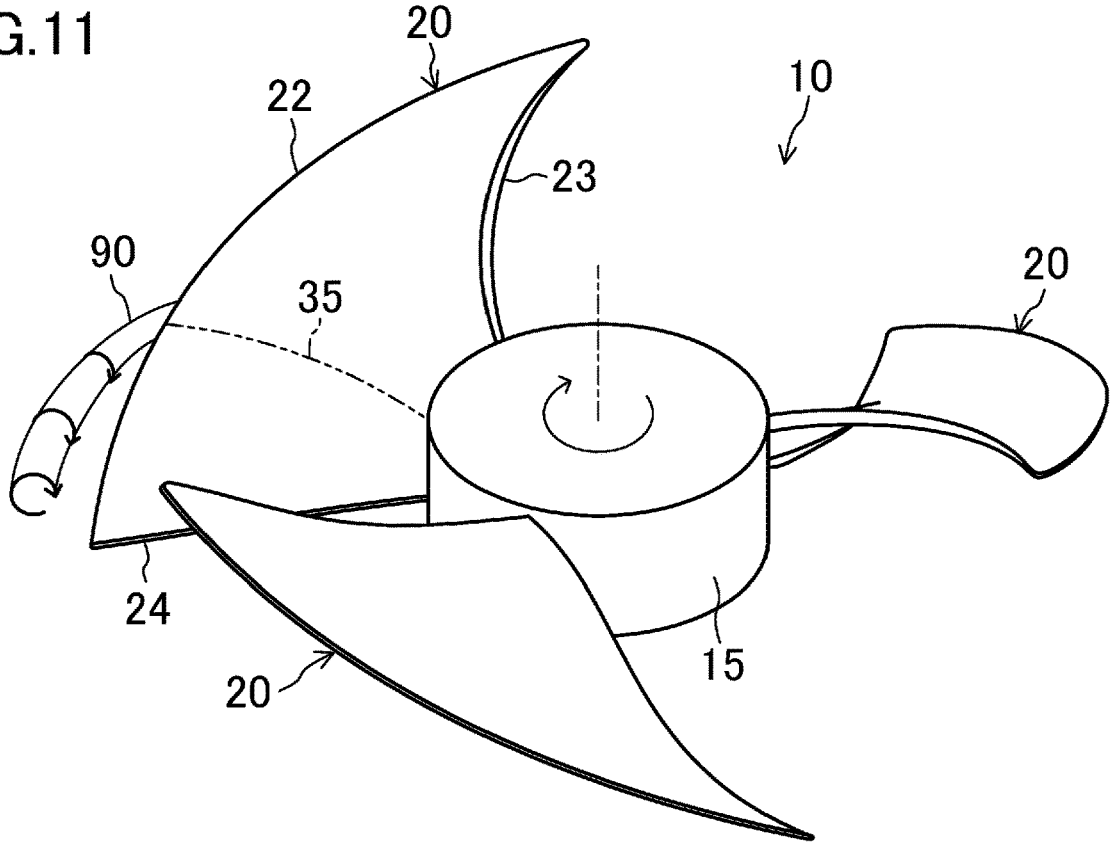
FIG. 11 is a perspective view of a propeller fan showing an airflow on the propeller fan of the first embodiment.

On the contrary, in each blade (20) of the propeller fan (10) of this embodiment, the maximum camber position ratio ($d_o/c_o$) at the blade end (22) is larger than the maximum camber position ratio ($d_i/c_i$) at the blade root (21). That is, at the blade end (22) of each blade (20), the maximum camber position A at which the camber becomes maximum in the blade cross section becomes relatively closer to the trailing edge (24) of the blade (20). As shown in FIG. 11, the position where the tip vortex (90) is generated in the blade (20) of this embodiment is closer to the trailing edge (24) of the blade (20) than that in the conventional blade (80) shown in FIG. 11. Therefore, the development of the tip vortex (90) is suppressed and the tip vortex (90) is shortened so that energy consumed for the generation of the tip vortex (90) is reduced. As a result, fan efficiency is improved, and power consumption of the fan motor driving the propeller fan (10) is reduced.

Here, there is a case where the airflow flowing from the leading edge (23) to the trailing edge (24) along the negative pressure surface (26) of the blade (20) separates from the negative pressure surface (26) of the blade (20) in the vicinity of the region where the airflow just passes by the maximum camber position A. Therefore, if the maximum camber position A is too close to the leading edge (23), the region where the airflow separates from the negative pressure surface (26) of the blade (20) is enlarged, which may lead to increase in blowing sound and decrease in fan efficiency. In order to avoid this problem, it is desirable to set the maximum camber position ratio (d/c) to a value equal to or greater than 0.5. In view of the above, in the blade (20) of this embodiment, the maximum camber position ratio (d/c) is set to equal to or greater than 0.55.

When the maximum camber position A is too close to the trailing edge (24), the shape of the blade cross section is sharply bent at a position near the trailing edge (24). Therefore, when the maximum camber position A is too close to the trailing edge (24), the airflow flowing along the negative pressure surface (26) of the blade (20) tends to separate from the negative pressure surface (26). When the airflow separates from the negative pressure surface (26) of the blade (20), there arises a possibility of increased blowing sound and decreased fan efficiency. In order to avoid this problem, it is desirable to set the maximum camber position ratio (d/c) to a value equal to or less than 0.8. In view of the above, in the blade (20) of this embodiment, the maximum camber position ratio (d/c) is set to equal to or less than 0.65.

As described above, in the blade (20) of this embodiment, the attaching angle $\alpha$ becomes larger in the blade cross section located closer to the blade root (21). The larger the attaching angle $\alpha$ is, the more easily airflow flowing along the negative pressure surface (26) of the blade (20) separates from the negative pressure surface (26). On the other hand, when the maximum camber position ratio (d/c) is substantially equal to or greater than 0.5, the smaller the maximum camber position ratio (d/c) is (i.e., the closer the maximum camber position A is to the leading edge (23)), the less likely airflow flowing along the negative pressure surface (26) of the blade (20) separates from the negative pressure surface (26). Therefore, in the blade (20) of this embodiment, in the region between the blade root (21) and the first reference blade cross section (33*a*), the maximum camber position ratio (d/c) gradually decreases in the direction toward the blade root (21) (i.e., as the attaching angle a increases), thereby making it difficult for the airflow from separating from the negative pressure surface (26) of the blade (20).

Advantages of First Embodiment

In each blade (20) of the propeller fan (10) of this embodiment, the inclination angle $\varphi$ gradually increases, in the direction toward the trailing blade end (22*b*), in an area extending from the reference radial cross section (41) located between the leading blade end (22*a*) and the trailing blade end (22*b*) to the trailing blade end (22*b*). Accordingly, in an area of the blade end (22) closer to a trailing blade end (22*b*) where the tip vortex (90) is to develop, air can smoothly flow from the positive pressure surface (25) side toward the negative pressure surface (26) side of the blade (20) via the blade end (22), thereby making it possible to suppress the variation in size of the tip vortex (90). Hence, according to this embodiment, the increase in noise and the decrease in fan efficiency due to the tip vortex (90) can be suppressed.

A blade of a conventional propeller fan has a rear area that is an area located behind the rear end plane (43) viewed in the rotation direction of the propeller fan. However, such a rear area scarcely contributes to the blowing ability of the propeller fan. Further, the friction between the rear area and air may lead to the consumption in power necessary for driving the propeller fan, which may result in a decrease in efficiency of the propeller fan.

On the contrary, in the propeller fan (10) of this embodiment, the trailing edge (24) of each blade (20) is positioned as a whole except the trailing blade end (22*b*) in front of the rear end plane (43) viewed in the rotation direction of the propeller fan (10). That is, the blade (20) of this embodiment has no rear area described above. Accordingly, in this embodiment, it is possible to reduce the consumed power due to the friction between the blade (20) and air, thereby improving the efficiency of the propeller fan (10) while ensuring the blowing ability of the propeller fan (10).

In each blade (20) of the propeller fan (10) of this embodiment, the maximum camber position ratio ($d_o/c_o$) at the blade end (22) is larger than the maximum camber position ratio ($d_i/c_i$) at the blade root (21). Therefore, the development of the tip vortex (90) is suppressed and the tip vortex (90) is shortened so that energy consumed for the generation of the tip vortex (90) is reduced. As a result, according to this embodiment, fan efficiency can be improved by reducing the loss of power of driving the fan to rotate, and the power consumption of the fan motor driving the propeller fan (10) can be reduced.

In each blade (20) of the propeller fan (10) of this embodiment, the maximum camber position ratio (d/c) is set to equal to or greater than 0.5 to equal to or less than 0.8. Therefore, the airflow is less likely to separate from the negative pressure surface (26) of the blade (20), so that the increase in air blowing sound caused by the airflow separated and the reduction in fan efficiency can be avoided.

In each blade (20) of the propeller fan (10) of this embodiment, the camber ratio (f/c) becomes maximum in the second reference blade cross section (33*b*), gradually decreases in the direction from the second reference blade cross section (33*b*) toward the blade root (21), and gradually decreases in the direction from the second reference blade cross section (33*b*) toward the blade end (22). Therefore, turbulence of airflow in the vicinity of the blade root (21) of each blade (20) can be suppressed, and the work amount of each blade (20) can be averaged over the entire blade (20). Therefore, according to this embodiment, it is possible to further reduce the loss of power of driving the fan to rotate, and to further improve the fan efficiency.

Moreover, in each blade (20) of the propeller fan (10) of this embodiment, the camber ratio (f/c) at the blade end (22) is smaller than the camber ratio (f/c) at the blade root (21). Therefore, it is possible to reduce the flow rate of air flowing from the positive pressure surface (25) side to the negative pressure surface (26) side via the blade end (22) of the blade (20), and the tip vortex (90) generated in the vicinity of the blade end (22) can be suppressed. Therefore, according to this embodiment, it is possible to further reduce the loss of power of driving the fan to rotate, and to further improve the fan efficiency.

Second Embodiment

The second embodiment will be described. A propeller fan (10) of this embodiment is obtained by changing the shape of blades (20) of the propeller fan (10) of the first embodiment. The propeller fan (10) of this embodiment will be described mainly through explaining a difference between the propeller fan (10) of this embodiment and the propeller fan (10) of the first embodiment.

Figure 13:
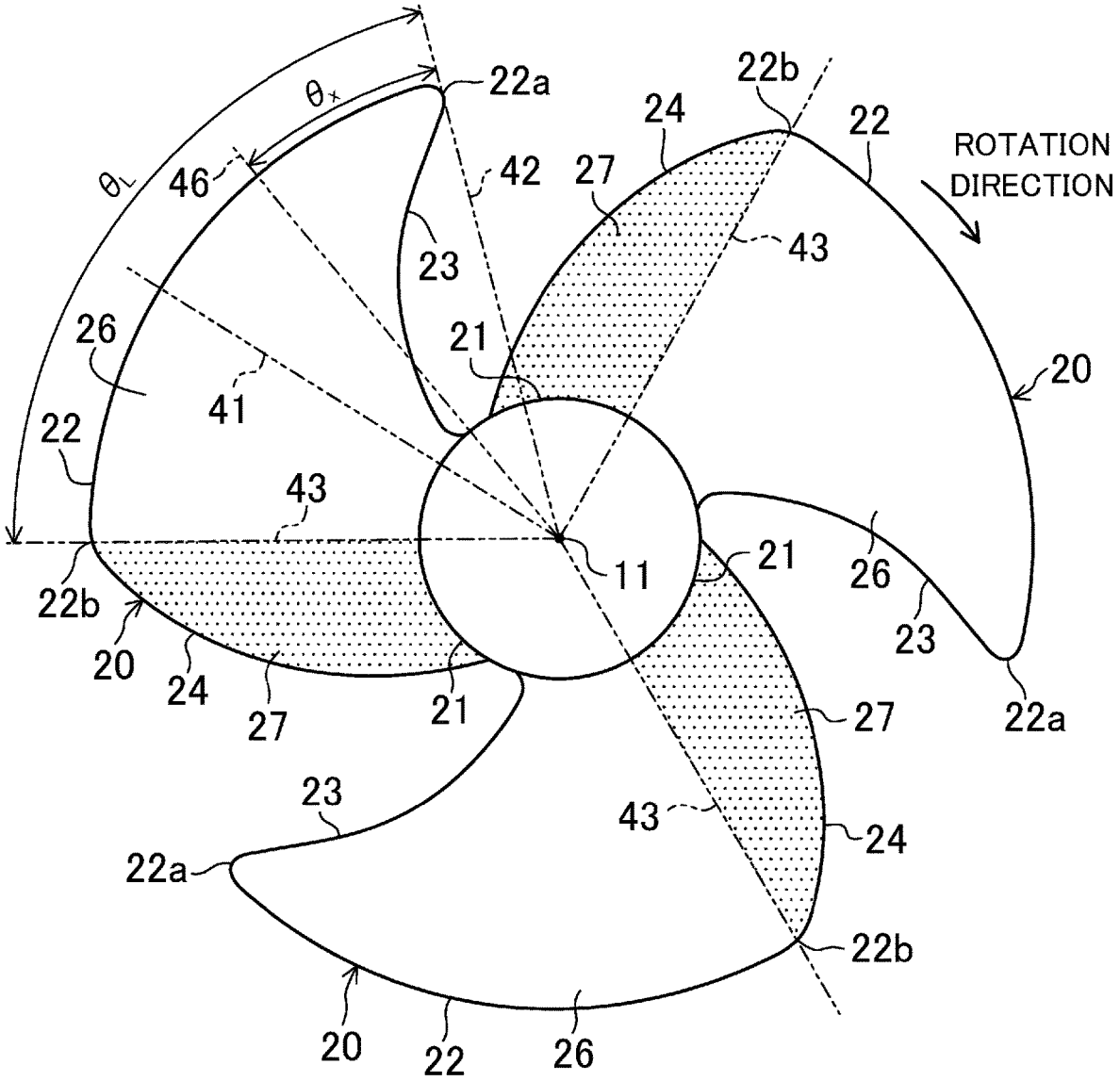
FIG. 13 is a plan view of the propeller fan of a second embodiment.

As shown in FIG. 13, in the propeller fan (10) of this embodiment, each blade (20) has a rear area (27). The rear area (27) is an area of each blade (20) marked with dots in FIG. 13, and is located behind the rear end plane (43) viewed in the rotation direction of the propeller fan. The trailing edge (24) of each blade (20) of this embodiment is positioned as a whole except the trailing blade end (22*b*) behind the rear end plane (43) viewed in the rotation direction of the propeller fan (10).

In the propeller fan (10) of this embodiment, the inclination angle φ of each blade (20) gradually decreases in the direction from the leading blade end (22*a*) toward the reference radial cross section (41), becomes minimum in the reference radial cross section (41), and gradually increases in the direction from the reference radial cross section (41) toward the trailing blade end (22*b*). Accordingly, also in the propeller fan (10) of this embodiment, the effect obtained through the change of the inclination angle φ as described above can be obtained, as in the case with the propeller fan (10) of the first embodiment.

In each blade (20) of the propeller fan (10) of this embodiment, the camber ratio (f/c) gradually increases in the direction from the blade root (21) toward the second reference blade cross section (33*b*), becomes maximum in the second reference blade cross section (33*b*), and gradually decreases in the direction from the second reference blade cross section (33*b*) toward the blade end (22). Accordingly, also in the propeller fan (10) of this embodiment, the effect obtained through the change of the camber ratio (f/c) as described above can be obtained, as in the case with the propeller fan (10) of the first embodiment.

In each blade (20) of the propeller fan (10) of this embodiment, the maximum camber position ratio (d/c) gradually increases in the direction from the blade root (21) toward the first reference blade cross section (33*a*), becomes maximum in the first reference blade cross section (33*a*), and gradually decreases in the direction from the first reference blade cross section (33*a*) toward the blade end (22). Accordingly, also in the propeller fan (10) of this embodiment, the effect obtained through the change of the maximum camber position ratio (d/c) as described above can be obtained, as in the case with the propeller fan (10) of the first embodiment.

INDUSTRIAL APPLICABILITY

As described above, the present invention is usable as a propeller fan for use in a blower or the like.

DESCRIPTION OF REFERENCE CHARACTERS

10 Propeller Fan
15 Hub
20 Blade
21 Blade Root
22 Blade End
22*a* Leading Blade End
22*b* Trailing Blade End
31 Chord Line
32 Mean Line
33 Reference Blade Cross Section (First Reference Blade Cross Section, Second Reference Blade Cross Section)
41 Reference Radial Cross Section
43 Rear End Plane
46 First Plane
47 Second Plane

The invention claimed is:

1. A propeller fan, comprising:

a hub formed into a cylindrical shape, and a plurality of blades extending outwards from a side of the hub, each of the plurality of blades including:

a radial cross section that is a cross section of each of the respective plurality of blades in a first plane including a center axis of the hub;

an inclination angle (φ) made by a straight line passing through an outer circumferential side end and an inner circumferential side end of the radial cross section with a second plane orthogonal to the center axis of the hub;

each of the respective plurality of blades end that is an outer circumferential side end portion of a blade;

a leading blade end that is a front end of the blade end viewed in a rotation direction of the propeller fan; and a trailing blade end that is a rear end of the blade end viewed in the rotation direction of the propeller fan, wherein the inclination angle (φ) monotonically increases, in a direction from an intermediate position toward the trailing blade end, in an area extending from the intermediate position located between the leading blade end and the trailing blade end to the trailing blade end, and the inclination angle (φ) at the intermediate position of each of the respective plurality of blades is a minimum value that is greater than zero.

2. The propeller fan of claim 1, wherein in each of the plurality of blades, the inclination angle (φ) increases, in the direction toward the trailing blade end, only in the area extending from the intermediate position located between the leading blade end and the trailing blade end to the trailing blade end.

3. The propeller fan of claim 1, wherein in each of the plurality of blades, the inclination angle (φ) decreases, in the direction toward the intermediate position, in an area extending from the leading blade end to the intermediate position, and the inclination angle (φ) becomes minimum at the intermediate position.

4. The propeller fan of claim 1, wherein in each of the plurality of blades, a plane including the trailing blade end and the center axis of the hub is a rear end plane, and a trailing edge of each of the respective plurality of blades is located on the rear end plane or in front of the rear end plane viewed in the rotation direction of the propeller fan.

5. The propeller fan of claim 1, wherein in each of the plurality of blades, a distance between a chord line and a mean line in a blade cross section is set to be a camber, a position on the chord line at which the camber becomes maximum in the blade cross section is set to be a. maximum camber position (A), a ratio of a distance (d) from a leading edge to the maximum camber position (A) in the blade cross section to a chord line length (c) is set to be a maximum camber position ratio (d/c), an end of each of the respective plurality of blades at the side of the hub is a blade root, the outer circumferential side end portion of each of the respective plurality of blades is the blade end, and the maximum camber position ratio (d/c) at the blade end is larger than the maximum camber position ratio (d/c) at the blade root.

6. The propeller fan of claim 1, wherein in each of the plurality of blades, a maximum value of a camber is a distance between a chord line and a mean line in a blade cross section and is set to be a maximum camber (f), a ratio of the maximum camber (f) to a chord line length (c) in the blade cross section is set to be a camber ratio (f/c), an end of each of the respective plurality of blades at the side of the hub is a blade root, the outer circumferential side end portion of each of the respective plurality of blades is the blade end, and the camber ratio (f/c) becomes maximum in a reference blade cross section located between the blade root and the blade end, monotonically decreases in a direction from the reference blade cross section toward the blade root and monotonically decreases in a direction from the reference blade cross section toward the blade end.

* * * * *